US010926568B2

(12) United States Patent
Nishimura et al.

(10) Patent No.: US 10,926,568 B2
(45) Date of Patent: Feb. 23, 2021

(54) IMAGE FORMING APPARATUS

(71) Applicant: CANON KABUSHIKI KAISHA, Tokyo (JP)

(72) Inventors: Shunsuke Nishimura, Tokyo (JP); Junichiro Nakabayashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 43 days.

(21) Appl. No.: 16/442,675

(22) Filed: Jun. 17, 2019

(65) Prior Publication Data

US 2019/0389237 A1 Dec. 26, 2019

(30) Foreign Application Priority Data

Jun. 22, 2018 (JP) ..... JP2018-118525

(51) Int. Cl.

| | |
|---|---|
| ***B65H 37/04*** | (2006.01) |
| ***B42C 19/02*** | (2006.01) |
| ***B42C 9/00*** | (2006.01) |
| ***G03G 15/00*** | (2006.01) |
| ***B65H 35/00*** | (2006.01) |
| *B42C 1/12* | (2006.01) |

(52) U.S. Cl.

CPC ..... *B42C 19/02* (2013.01); *B42C 9/0025* (2013.01); *B65H 35/0086* (2013.01); *B65H 37/04* (2013.01); *G03G 15/6523* (2013.01); *B42C 1/12* (2013.01)

(58) Field of Classification Search

CPC ... B42C 19/02; B42C 9/0025; B65H 35/0086; B65H 37/04; G03G 15/6523; G03G 15/553; B26D 7/18

See application file for complete search history.

(56) References Cited

U.S. PATENT DOCUMENTS

| | | | | |
|---|---|---|---|---|
| 5,746,162 | A * | 5/1998 | Hosoi | B65H 39/10 270/37 |
| 6,813,472 | B2 * | 11/2004 | Aizawa | B26D 7/015 399/388 |
| 7,987,751 | B2 * | 8/2011 | Shiokawa | G03G 15/6523 83/147 |
| 10,676,305 | B2 * | 6/2020 | Doi | B26D 7/1854 |
| 2003/0215275 | A1 * | 11/2003 | Tamura | B26D 7/18 399/407 |

(Continued)

FOREIGN PATENT DOCUMENTS

JP 2006-199428 A 8/2006

*Primary Examiner* — Patrick H Mackey
(74) *Attorney, Agent, or Firm* — Venable LLP

(57) ABSTRACT

Provided is an image forming apparatus configured to form an image on a sheet. A case binding apparatus is configured to cut predetermined sides of a sheet bundle formed by binding a plurality of sheets to perform bookbinding. The case binding apparatus includes a cutting-waste box configured to collect cutting waste produced by the cutting and a cutting-waste full load detection sensor configured to detect a fully loaded state of the cutting-waste box with the cutting waste collected in the cutting-waste box. When the sheet onto which the image is to be formed is not a last sheet in the sheet bundle, the image forming apparatus does not interrupt image formation processing in response to the fully loaded state of the waste box detected by the detector when an order of the sheet in the sheet bundle is smaller than a predetermined order.

9 Claims, 14 Drawing Sheets

(56) References Cited

U.S. PATENT DOCUMENTS

| | | | | |
|---|---|---|---|---|
| 2005/0115377 | A1* | 6/2005 | Kobayashi | G03G 15/6582 83/684 |
| 2005/0211035 | A1* | 9/2005 | Tamura | B26D 7/18 83/109 |
| 2007/0052147 | A1* | 3/2007 | Tamura | G03G 15/6582 270/58.07 |
| 2010/0247203 | A1 | 9/2010 | Watanabe et al. | |

* cited by examiner

IMAGE FORMING APPARATUS

BACKGROUND OF THE INVENTION

Field of the Invention

The present disclosure relates to an image forming apparatus including a bookbinding apparatus configured to bind a sheet bundle formed by gathering sheets each having an image formed thereon.

Description of the Related Art

An image forming apparatus such as a copying machine has, in some cases, a configuration for allowing a post-processing apparatus, which is configured to perform post-processing such as bookbinding for sheets after image formation, to be mountable thereto. The bookbinding is performed through processing such as gluing processing and cutting processing. In the gluing processing, glue is applied onto one side of a sheet bundle including a plurality of sheets. In the cutting processing, sides of the sheet bundle other than the glue-applied surface are cut off. The sheet bundle is bound through the gluing processing and is formed into a predetermined size through the cutting processing. When detecting a cutting-waste full load state in which cutting waste produced in the cutting processing exceeds a predetermined amount, the image forming apparatus interrupts image formation processing (Japanese Patent Application Laid-Open No. 2006-199428). With the interruption of the image formation processing, overflow and dispersion of the cutting waste can be prevented in advance. The image forming apparatus notifies a user of full load of the cutting waste. After removal of the cutting waste, the image forming apparatus restarts the image formation processing.

In the image forming apparatus, the image formation processing is interrupted under the cutting-waste full load state. As a result, downtime is generated to decrease productivity. In order to reduce the decrease in productivity as much as possible, when the cutting waste is fully loaded, a user immediately removes the cutting waste in response to the notification from the image forming apparatus to clear the cutting-waste full load state. Even when a user immediately removes the cutting waste, however, it is difficult to restrain the generation of the downtime itself. The present disclosure has a main object to provide an image forming apparatus which restrains generation of downtime at the time of full load of cutting waste.

SUMMARY OF THE INVENTION

An image forming apparatus according to the present disclosure includes: an image forming unit configured to form an image on a sheet; a bookbinding unit configured to perform bookbinding of a sheet bundle including a plurality of sheets; a cutting unit configured to cut a predetermined side of the sheet bundle formed by the bookbinding in the bookbinding unit; a waste box configured to collect cutting waste produced by the cutting; a detector configured to detect a fully loaded state of the waste box, which corresponds to collection of a predetermined amount of the cutting waste in the waste box; and a controller configured to: control, when an order of the sheet in the sheet bundle, on which the image is to be formed, is smaller than a predetermined order, the image forming unit to not perform interruption of image formation processing which is due to detection of the fully loaded state of the waste box detected by the detector, and; control, when the order of the sheet is the predetermined order, the image forming unit to interrupt the image formation processing in accordance with the fully loaded state of the waste box, which is detected by the detector.

Further features of the disclosure will become apparent from the following description of exemplary embodiments (with reference to the attached drawings).

DESCRIPTION OF THE EMBODIMENTS

An image forming apparatus according to an embodiment of the present invention is described below with reference to the drawings.

Overall Configuration

Figure 1:
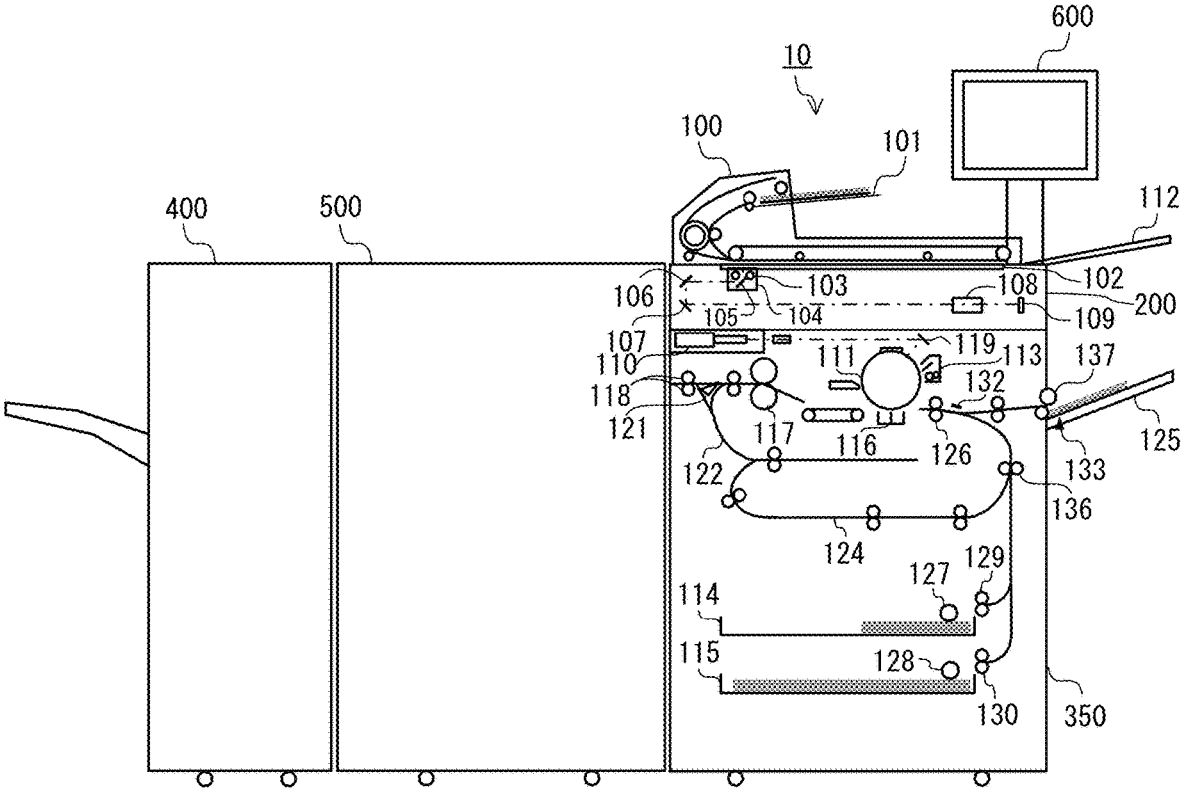
FIG. 1 is a configuration view of an image forming system.

FIG. 1 is a configuration view of an image forming system including an image forming apparatus of this embodiment. The image forming system includes an image forming apparatus 10, a case binding apparatus 500, and a finisher apparatus 400. The case binding apparatus 500 and the finisher apparatus 400 are examples of a post-processing apparatus. The image forming apparatus 10 includes an image reader 200, a printer 350, and an operation display apparatus 600. The image reader 200 is configured to read an image from an original. The printer 350 is configured to form the read image on a sheet. An original feeding apparatus 100 configured to feed the original is mounted to the image reader 200.

The image forming apparatus 10 is configured to form an image on a sheet. The case binding apparatus 500 is configured to receive a plurality of sheets after the image formation from the image forming apparatus 10, and to perform bookbinding processing. When the received sheets are not to be bound, the case binding apparatus 500 conveys the received sheets to the finisher apparatus 400 without performing the binding processing for the received sheets. The finisher apparatus 400 performs predetermined post-processing for the sheets received from the image forming apparatus 10 via the case binding apparatus 500 and then discharge the sheets. The finisher apparatus 400 performs post-processing for the sheets as a bundle, for example, bundle discharge processing, binding processing, and folding processing.

Image Forming Apparatus

The original feeding apparatus 100 includes an original tray 101 and a discharge tray 112. On the original tray 101, an original is placed with a surface to be read being oriented upward. The original feeding apparatus 100 is configured to sequentially feed the originals placed on the original tray 101 from a first page. Each of the fed originals is conveyed on a platen glass 102 on which a reading position for the image reader 200 is set via a curved path to be discharged to the discharge tray 112.

The image reader 200 includes the platen glass 102, a scanner unit 104, an optical system, and an image sensor 109. The optical system includes mirrors 106 and 107 and a lens 108. The scanner unit 104 includes a lamp 103 and a mirror 105. The reading position set on the platen glass 102 is a position to which the lamp 103 radiates light, and is fixed. The scanner unit 104 radiates the light onto the original with use of the lamp 103 when the original passes over the reading position on the platen glass 102. Light reflected by the original is guided to the lens 108 via the mirrors 105, 106, and 107. The lens 108 images the reflected light onto an imaging surface of the image sensor 109. The image sensor 109 converts the imaged reflected light into an electric signal to generate image data representing the image of the original. The image reader 200 reads the image from the original in the manner described above. The image reader 200 is configured to transmit the generated image data to the printer 350. A direction orthogonal to an original conveying direction corresponds to a main scanning direction, and the original conveying direction corresponds to a sub-scanning direction.

The image reader 200 having the configuration described above reads the image of the original for each line in the main scanning direction when the original passes over the reading position with use of the image sensor 109. During the reading, the original is conveyed by the original feeding apparatus 100. In this manner, the image reader 200 can read the whole image of the original. Such a reading method is referred to as "first reading method".

The image reader 200 can also read the original without using the original feeding apparatus 100. In this case, a user places the original on the platen glass 102. The image reader 200 reads the original while moving the scanner unit 104 in the sub-scanning direction. Such a reading method is referred to as "second reading method".

The printer 350 includes a photosensitive drum 111, an exposure device 110, a polygon mirror 119, a developing device 113, a transfer portion 116, and a fixing device 117, which are configured to form an image on a sheet. The exposure device 110 outputs a laser beam that is modulated based on the image data acquired from the image reader 200. The laser beam is radiated onto the photosensitive drum 111 while being scanned by the polygon mirror 119. On the photosensitive drum 111, an electrostatic latent image in accordance with the scanned laser beam is formed. In the second reading method, the exposure device 110 outputs the laser beam so that an erected image (an image that is not a mirror image) is formed. The electrostatic latent image formed on the photosensitive drum 111 is visualized as a developer image by a developer supplied from the developing device 113.

The printer 350 includes an upper cassette 114 and a lower cassette 115. In each of the upper cassette 114 and the lower cassette 115, sheets onto each of which an image is to be formed are stored. The sheet is fed from the upper cassette 114 or the lower cassette 115 to a conveyance path. In the illustrated example, sheets to be stored in the upper cassette 114 and sheets to be stored in the lower cassette 115 have different sizes, respectively. The sheet of the size in accordance with a print job is fed. A pickup roller 127 configured to feed the sheet to the conveyance path is provided to the upper cassette 114. A pickup roller 128 configured to feed the sheet to the conveyance path is provided to the lower cassette 115. A pair of feed rollers 129, a pair of feed rollers 130, a pair of vertical path rollers 136, and a pair of registration rollers 126 are provided in the conveyance path so as to convey the fed sheet. The pair of feed rollers 129, the pair of feed rollers 130, and the pair of vertical path rollers 136 are configured to convey the fed sheet to the pair of registration rollers 126. On an upstream side of the pair of registration rollers 126 in a sheet conveying direction, a pre-registration sensor 132 is provided. When the pre-registration sensor 132 detects a leading edge of the sheet and then the sheet reaches the pair of registration rollers 126, the conveyance of the sheet is temporarily stopped.

The printer 350 includes a manual feed tray 125. On the manual feed tray 125, sheets, on each of which an image is to be formed, are placed. A pickup roller 137 configured to feed the sheet is provided to the manual feed tray 125. The manual feed tray 125 includes a sheet sensor 133 configured to detect the presence or absence of the sheet. When the sheet fed from the manual tray 125 reaches the pair of registration rollers 126, the conveyance of the sheet is temporarily stopped.

The pair of registration rollers 126 warps the leading edge side of the sheet at the time of stop of the conveyance of the sheet to thereby perform a skew correction. The leading edge of the sheet abuts against the pair of registration rollers 126, which has stopped rotating. After that, the sheet is conveyed by a predetermined amount to warp the sheet. After the skew correction, the pair of registration rollers 126 restarts conveying the sheet at timing in synchronization with the start of irradiation of the laser beam by the exposure device 110. The sheet is conveyed between the photosensitive drum 111 and the transfer portion 116. The transfer portion 116 transfers the developer image formed on the photosensitive drum 111 onto the sheet.

The sheet onto which the developer image has been transferred is conveyed from the transfer portion 116 to the fixing device 117. The fixing device 117 is configured to heat and pressurize the sheet to fix the developer image onto the sheet. The sheet, which has passed through the fixing device 117, is discharged through a flapper 121 and a pair of discharge rollers 118, which are provided in the conveyance path, from the printer 350 to an outside of the image forming apparatus 10. In this embodiment, the sheet, which is discharged to the outside of the image forming apparatus 10, is conveyed to the case binding apparatus 500.

When the sheet is discharged under a state in which an image formation surface is oriented downward (delivered face-down), the printer 350 switches the flapper 121 to convey the sheet, which has passed through the fixing device 117, to an inversion path 122. After a trailing edge of the sheet passes over the flapper 121, the printer 350 switches back the sheet to discharge the sheet to the outside of the image forming apparatus 10 through the pair of discharge rollers 118. A mode in which the sheet is discharged face-down is referred to as "inverted sheet discharge". The inverted sheet discharge is performed when images of a plurality of pages are sequentially formed from a first page. Through the inverted sheet discharge, the discharged sheets are arranged in an ascending order. The inverted sheet discharge is performed, for example, when the image read with use of the original feeding apparatus 100 is to be formed or when the image in accordance with the image data acquired from an external computer is to be formed.

When a hard sheet such as an OHP sheet is discharged, the sheet is discharged by the pair of discharge rollers 118 under a state in which the image formation surface is oriented upward (delivered face-up) without being discharged to the inversion path 122. When the images are to be formed on both surfaces of the sheet, the printer 350 conveys the sheet to the inversion path 122 and then to a duplex-printing conveyance path 124. The sheet is fed to the pair of registration rollers 126 again via the duplex-printing conveyance path 124. The control described above is referred to as "duplex-printing circulation control". The sheet having both surfaces, on each of which the image is formed, is discharged by the pair of discharge rollers 118 without being guided to the inversion path 122.

Control System

Figure 2:
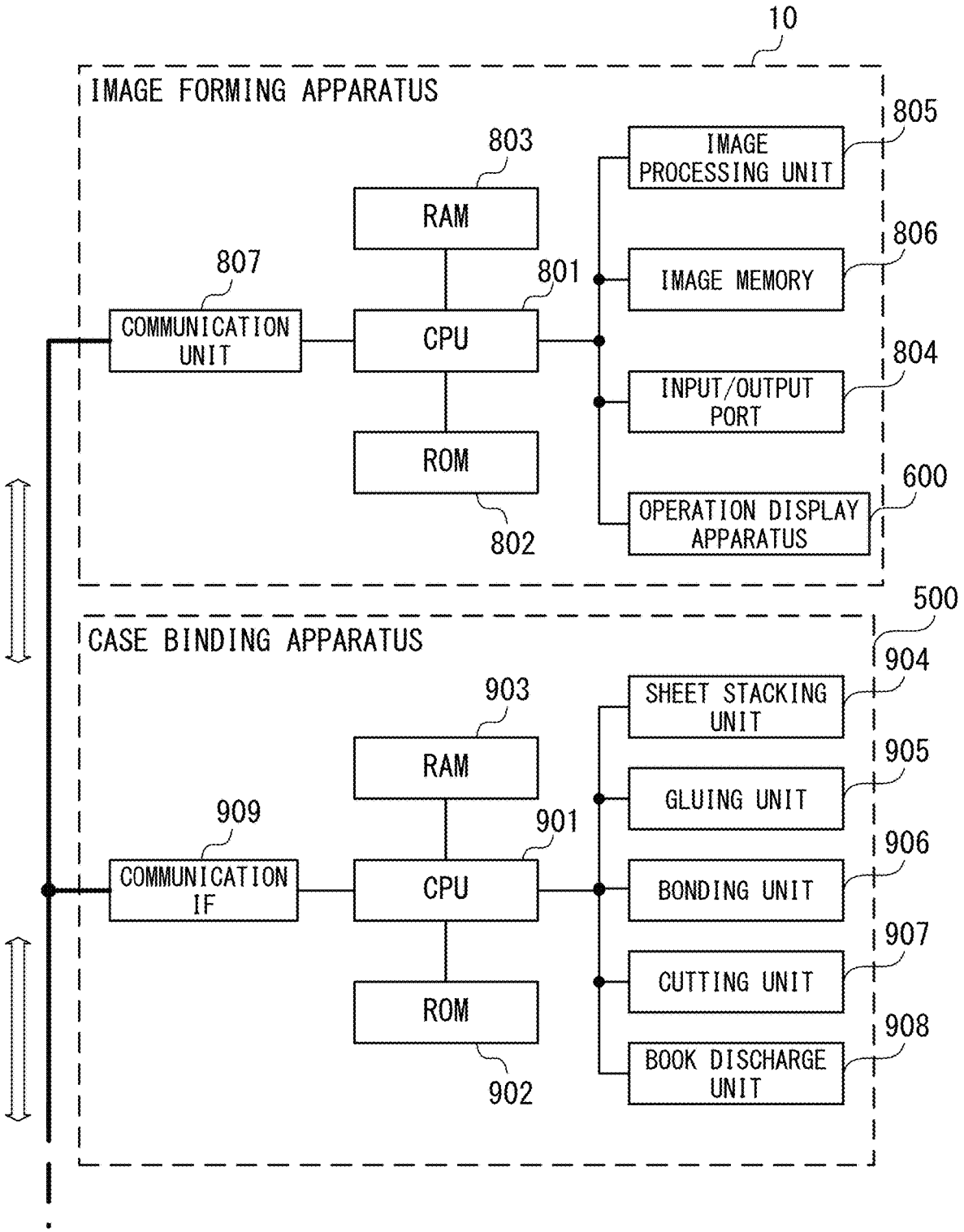
FIG. 2 is an explanatory diagram for illustrating a control system.

FIG. 2 is an explanatory diagram for illustrating a control system configured to control an operation of the image forming apparatus 10 and an operation of the case binding apparatus 500.

The image forming apparatus 10 includes a central processing unit (CPU) 801, a read only memory (ROM) 802, and a random access memory (RAM) 803. The CPU 801 executes a computer program stored in the ROM 802 with use of the RAM 803 as a work area to control the operation of the image forming apparatus 10. The RAM 803 functions as a backup RAM in which data is not deleted in part of a storage area even after power is turned off Δn image processing unit 805, an image memory 806, an input/output port 804, the operation display apparatus 600, and a communication interface (IF) 807 are connected to the CPU 801.

The image processing unit 805 is configured to perform predetermined image processing for the image data acquired from the image reader 200 or an external apparatus to correct, for example, a position, a density, and a tone of an image to be formed. The image memory 806 is configured to store the corrected image data. The CPU 801 is configured to control light emission from the exposure device 110 based on the corrected image data. Various loads such as a motor and a clutch and, for example, a sensor configured to detect a position of the sheet are connected to the input/output port 804. The CPU 801 is configured to sequentially control an input and an output via the input/output port 804 to execute the image formation processing. The CPU 801 detects, for example, a position of conveyance of the sheet in accordance with a result of detection by the sensor to control the load in accordance with the detected position of conveyance of the sheet to thereby perform processing of conveying the sheet and the image formation processing.

Figure 3:
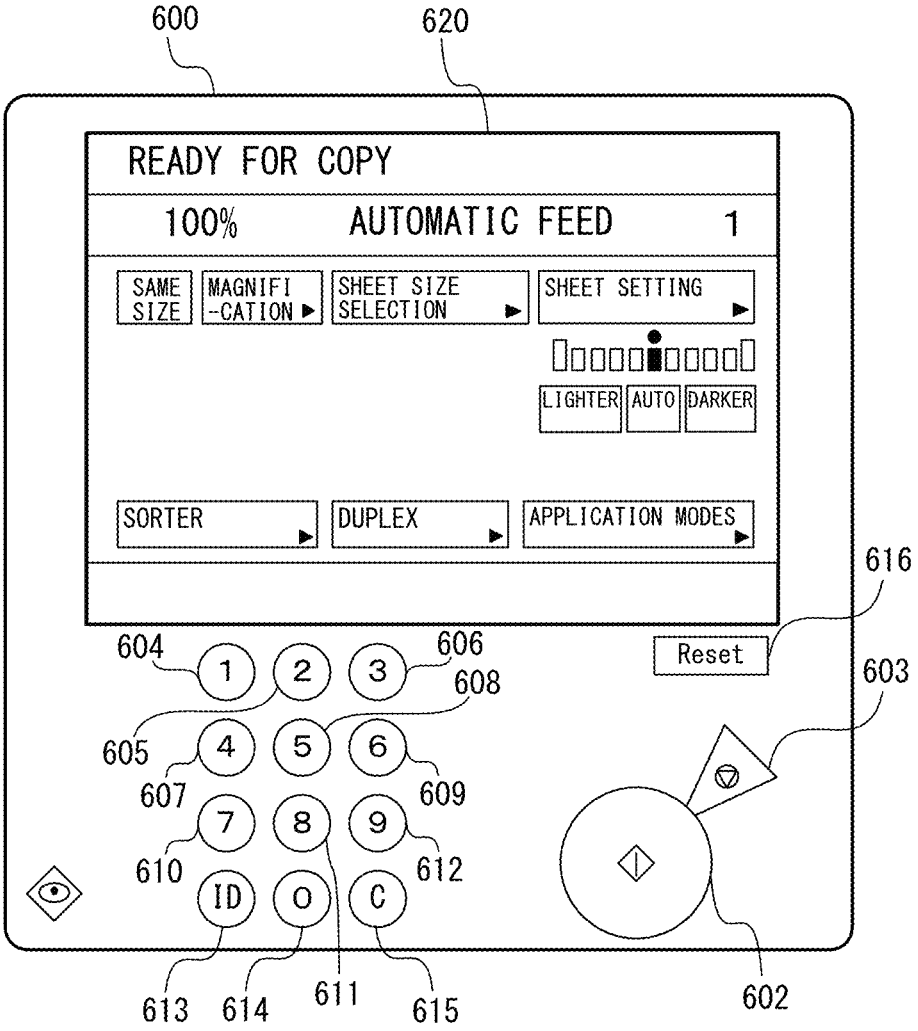
FIG. 3 is an exemplary view of an operation display apparatus.

The operation display apparatus 600 is an interface including input devices configured to receive a command given by a user and an output device configured to provide various information to the user. FIG. 3 is an exemplary view of the operation display apparatus 600. The operation display apparatus 600 includes, for example, a start key 602, a stop key 603, numeric keys 604 to 612 and 614, an ID key 613, a clear key 615, and a reset key 616 as input devices. The start key 602 is an input key configured to start an image formation operation. The stop key 603 is an input key configured to interrupt the image formation operation. The numeric keys 604 to 612 and 614 are input keys configured to, for example, set the number of copies. The operation display apparatus 600 includes a display unit 620 having a touch panel as the output device. The display unit 620 can display software keys on a screen.

The communication IF 807 controls communication between the case binding apparatus 500 and the finisher apparatus 400. The CPU 801 can communicate with the case binding apparatus 500 via the communication IF 807.

The case binding apparatus 500 includes a CPU 901, a ROM 902, and a RAM 903. The CPU 901 executes a computer program stored in the ROM 902 with use of the RAM 903 as a work area to control the operation of the case binding apparatus 500. The RAM 903 functions as a backup RAM in which data is not deleted in part of a storage area even after power is turned off. A sheet stacking unit 904, a gluing unit 905, a bonding unit 906, a cutting unit 907, a book discharge unit 908, and a communication IF 909 are connected to the CPU 901.

The communication IF 909 controls communication between the image forming apparatus 10 and the finisher apparatus 400. The CPU 901 can communicate with the image forming apparatus 10 via the communication IF 909. The CPU 901 controls operations of the sheet stacking unit 904, the gluing unit 905, the bonding unit 906, the cutting unit 907, and the book discharge unit 908 in accordance with a command from the CPU 801.

Case Binding Apparatus

Figure 4:
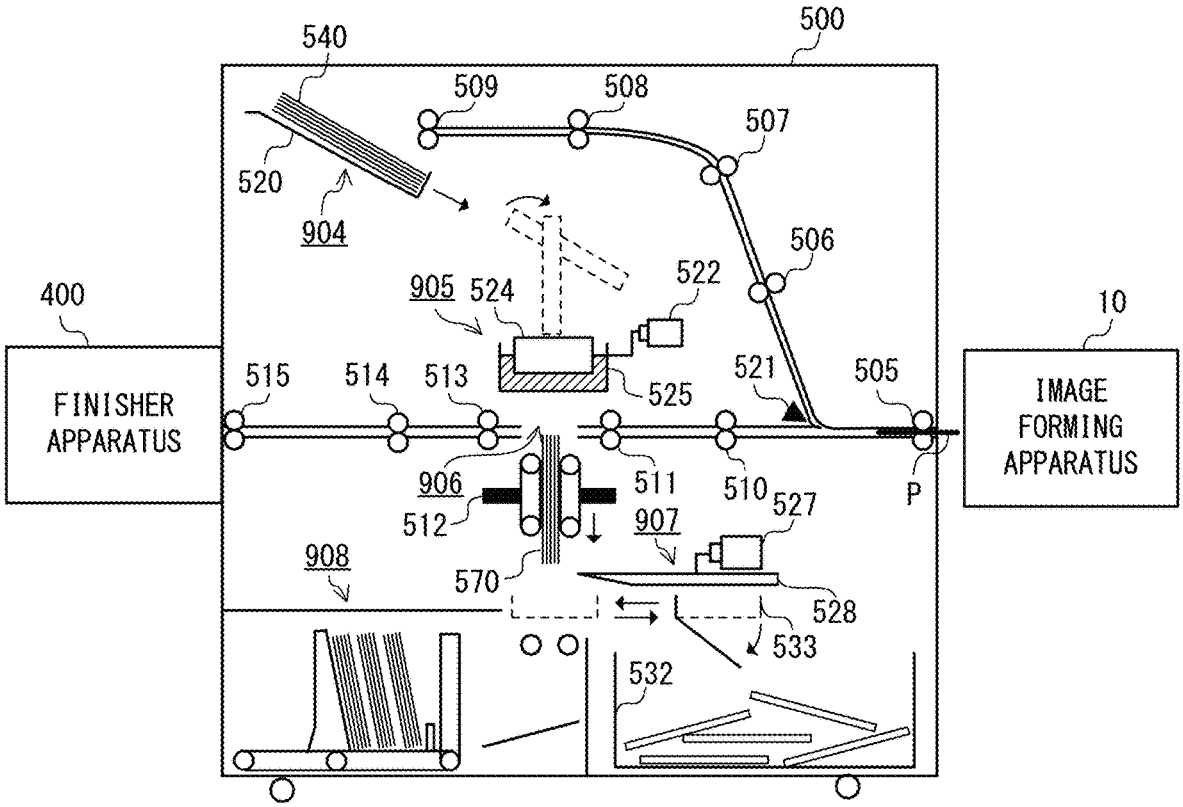
FIG. 4 is a configuration view of a case binding apparatus.

FIG. 4 is a configuration view of the case binding apparatus 500. As described above, the case binding apparatus 500 includes the sheet stacking unit 904, the gluing unit 905, the bonding unit 906, the cutting unit 907, and the book discharge unit 908. The sheet stacking unit 904 is configured to stack a plurality of sheets P discharged from the image forming apparatus 10 in a bookbinding mode to form a sheet bundle 540. The gluing unit 905 is configured to apply glue to one end surface of the sheet bundle 540. The bonding unit 906 is configured to bond a cover sheet onto the sheet bundle 540 having the glue-applied end surface. In this manner, a book 570 is formed. The cutting unit 907 is configured to cut three sides of the book 570 other than the glue-applied end surface so as to align end surfaces of the sheets of the book 570. The three sides of the book 570 are cut off to complete the bookbinding. The book discharge unit 908 is configured to discharge the completed book 570. A series of a flow of bookbinding processing is described below.

The sheet stacking unit 904 includes a sheet stacking tray 520 on which the sheets are to be stacked. On the sheet stacking tray 520, the plurality of sheets P discharged from the image forming apparatus 10 in the bookbinding mode are stacked. The plurality of stacked sheets P are formed as the sheet bundle 540. The case binding apparatus 500 includes pairs of conveyance rollers 505, 506, 507, and 508, and a pair of stacking-unit discharge rollers 509, which are configured to convey the sheet P discharged from the image forming apparatus 10 to the sheet stacking unit 904. The sheets P are conveyed by the pairs of conveyance rollers 505, 506, 507, and 508 and the pair of stacking-unit discharge rollers 509 to be stacked on the sheet stacking tray 520 as the sheet bundle 540.

After all the sheets forming the one sheet bundle 540 are stacked on the sheet stacking tray 520, the sheet bundle 540 is moved by a gripping member (not shown) to the gluing unit 905. The gluing unit 905 includes a glue container 525, a glue application roller 524, and a glue application roller control motor 522. The gluing unit 905 is configured to apply glue onto a lower surface of the sheet bundle 540. The bonding unit 906 is configured to bond the cover sheet discharged from the image forming apparatus 10 onto the glue-applied sheet bundle 540 to form the book 570. The bonding unit 906 transfers the book 570 to a trim gripper 512. The book 570 is conveyed to the cutting unit 907 by the trim gripper 512. The cutting unit 907 includes a cutter control motor 527 and a cutter 528. The cutting unit 907 moves the cutter 528 in a horizontal direction with use of the cutter control motor 527 to cut the book 570. At a position at which cutting waste is produced as a result of cutting falls, a cutting-waste receiving box 533 is provided. Thus, the cutting waste falls into the cutting-waste receiving box 533. The cutting waste in the cutting-waste receiving box 533 is collected into a cutting-waste box 532 after termination of a series of cutting operations. The book 507, for which the cutting with use of the cutting unit 907 has been terminated, is conveyed from the cutting unit 907 to the book discharge unit 908 to be discharged therefrom.

When operating in the bookbinding mode, the case binding apparatus 500 performs the series of bookbinding operations described above. Besides in the bookbinding mode, the case binding apparatus 500 can also operate in a discharge mode in which the sheets P are discharged to the finisher apparatus 400 without performing bookbinding. Operation modes such as the bookbinding mode and the discharge mode are set by a user with use of, for example, the operation display apparatus 600. The CPU 801 of the image forming apparatus 10 instructs the CPU 901 of the case binding apparatus 500 to set the operation mode of the case binding apparatus 500.

A switching flapper 521 is provided on a downstream side of the pair of conveyance rollers 505 in the sheet conveying direction. The switching flapper 521 selectively guides the sheet P conveyed by the pair of conveyance rollers 505 to any one of the sheet stacking tray 520 and the finisher apparatus 400. In the operation mode other than the bookbinding mode, the switching flapper 521 guides the sheet P toward the finisher apparatus 400. In this case, the sheet P is conveyed to the finisher apparatus 400 by the pair of conveyance rollers 505, pairs of conveyance rollers 510, 511, 513, and 514, and a pair of discharge rollers 515.

An order of conveyance of the sheet P in the case binding apparatus 500 when operating in the bookbinding mode is described below. FIG. 5, FIG. 6, FIG. 7, and FIG. 8 are explanatory views for illustrating the order of conveyance of the sheet P in the case binding apparatus 500 when operating in the bookbinding mode.

Figure 5:
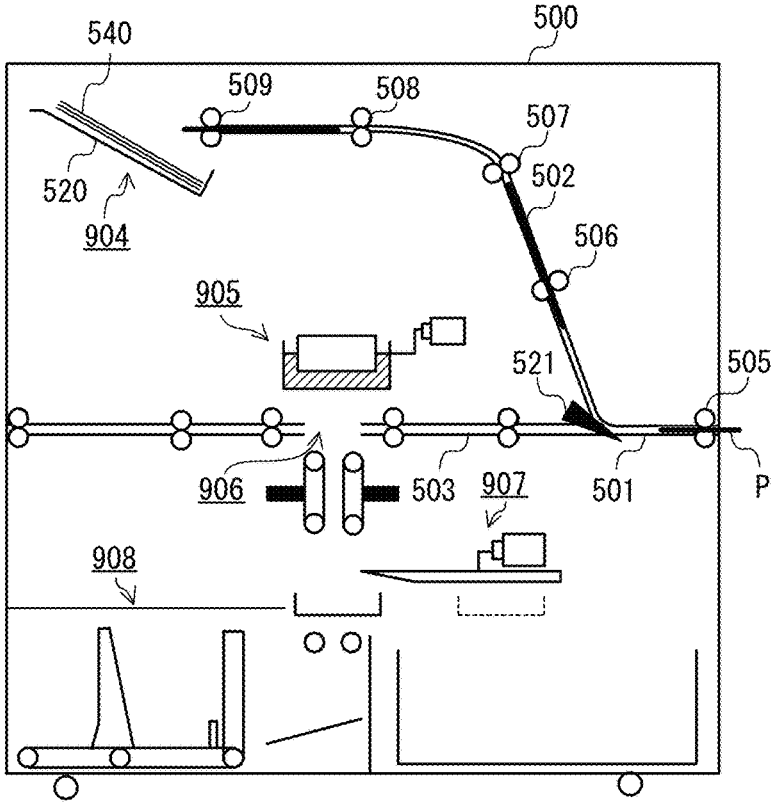
FIG. 5 is an explanatory view for illustrating an order of conveyance of a sheet in the case binding apparatus.
Figure 6:
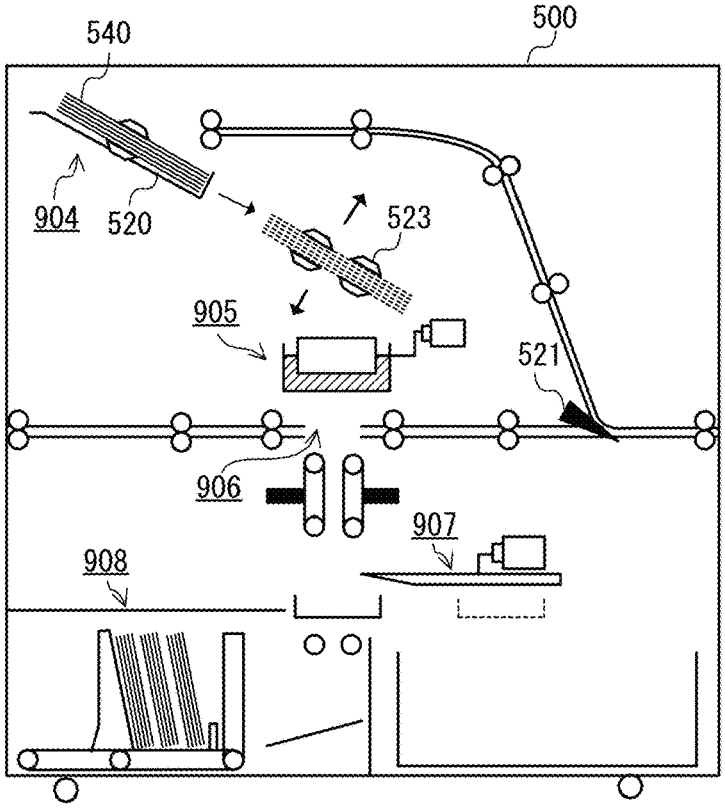
FIG. 6 is an explanatory view for illustrating the order of conveyance of the sheet in the case binding apparatus.

FIG. 5 is an illustration of a case in which the sheet P is conveyed from the image forming apparatus 10 to the sheet stacking unit 904. The case binding apparatus 500 receives the sheet P discharged from the image forming apparatus 10 through the pair of conveyance rollers 505 to guide the received sheet P to a conveyance path 501. When the sheet P is an inner sheet of the sheet bundle, the sheet P received through the pair of conveyance rollers 505 is guided to a conveyance path 502 by the switching flapper 521. In the conveyance path 502, the sheet P is conveyed to the sheet stacking unit 904 through the pairs of conveyance rollers 506, 507, and 508, and the pair of stacking-unit discharge rollers 509. The sheet P is discharged through the pair of stacking-unit discharge rollers 509 to the sheet stacking tray 520. After all the sheets P serving as the inner sheets are discharged onto the sheet stacking tray 520, as illustrated in FIG. 6, the sheet bundle 540 of the inner sheets is gripped by a gluing gripper 523. The gripped sheet bundle 540 is moved from the sheet stacking unit 904 to a position above the gluing unit 905.

Figure 7:
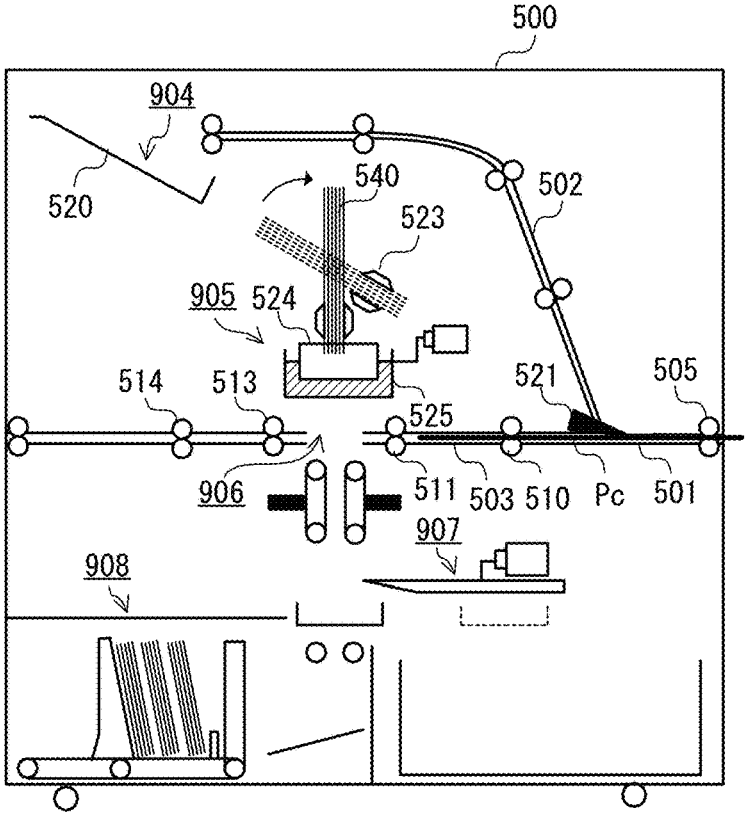
FIG. 7 is an explanatory view for illustrating the order of conveyance of the sheet in the case binding apparatus.

The sheet bundle 540 of the inner sheets, which has been moved to the position above the gluing unit 905, is rotated so as to be oriented perpendicular to the gluing unit 905 under a state of being gripped by the gluing gripper 523 as illustrated in FIG. 7. Through the rotation, an end surface serving as a spine of the sheet bundle 540 is opposed to the gluing unit 905. After that, the glue container 525 and the glue application roller 524 are moved along the sheet bundle 540 to apply the glue onto the end portion (end surface serving as the spine) of the sheet bundle 540.

Figure 8:
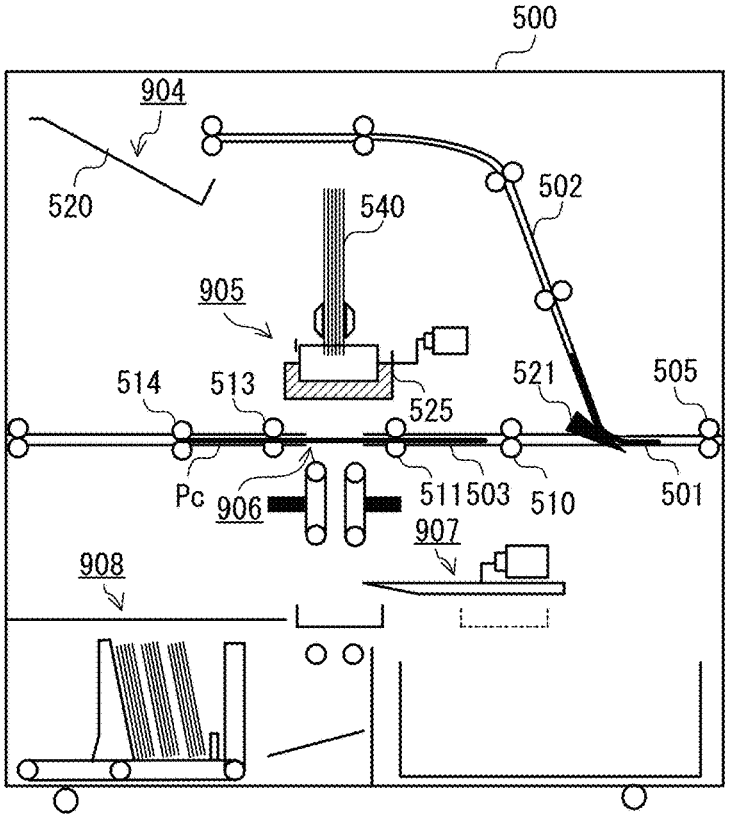
FIG. 8 is an explanatory view for illustrating the order of conveyance of the sheet in the case binding apparatus.

During the gluing, a cover sheet Pc is discharged from the image forming apparatus 10 to be loaded into the case binding apparatus 500. The cover sheet Pc, which has been received through the pair of conveyance rollers 505, is guided from the conveyance path 501 to a conveyance path 503 by the switching flapper 521, and conveyed by the pairs of conveyance rollers 510, 511, and 513. A sensor (not shown) is provided on a downstream side of the pair of conveyance rollers 513 in the conveyance path 503. As illustrated in FIG. 8, after a leading edge of the cover sheet Pc is detected by the sensor and the cover sheet Pc is conveyed over a predetermined distance, the conveyance of the cover sheet Pc is stopped. The cover sheet Pc has such a size that a trailing edge of the cover sheet Pc has completely passed under the switching flapper 521 at a time at which the cover sheet Pc is stopped in the conveyance path 503.

In a case in which the sheet bundles 540 are to be formed continuously, even while the cover sheet Pc is present in the conveyance path 503, the switching flapper 521 can perform switching so that the sheet P is conveyed to the conveyance path 502. In this manner, the case binding apparatus 500 can receive the inner sheets for the subsequent sheet bundle 540 from the image forming apparatus 10 and convey the inner sheets to the sheet stacking tray 520 from the conveyance path 501 via the conveyance path 502.

Gluing Unit

Figure 9:
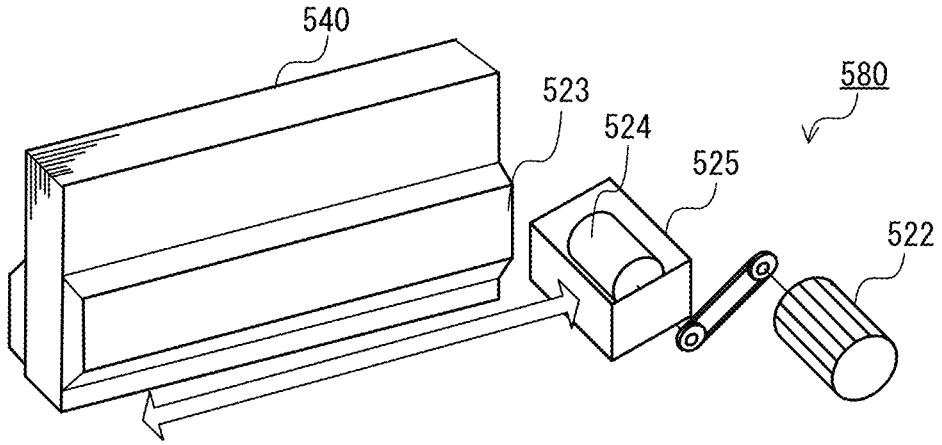
FIG. 9 is an explanatory view for illustrating a configuration of a gluing unit.
Figure 10:
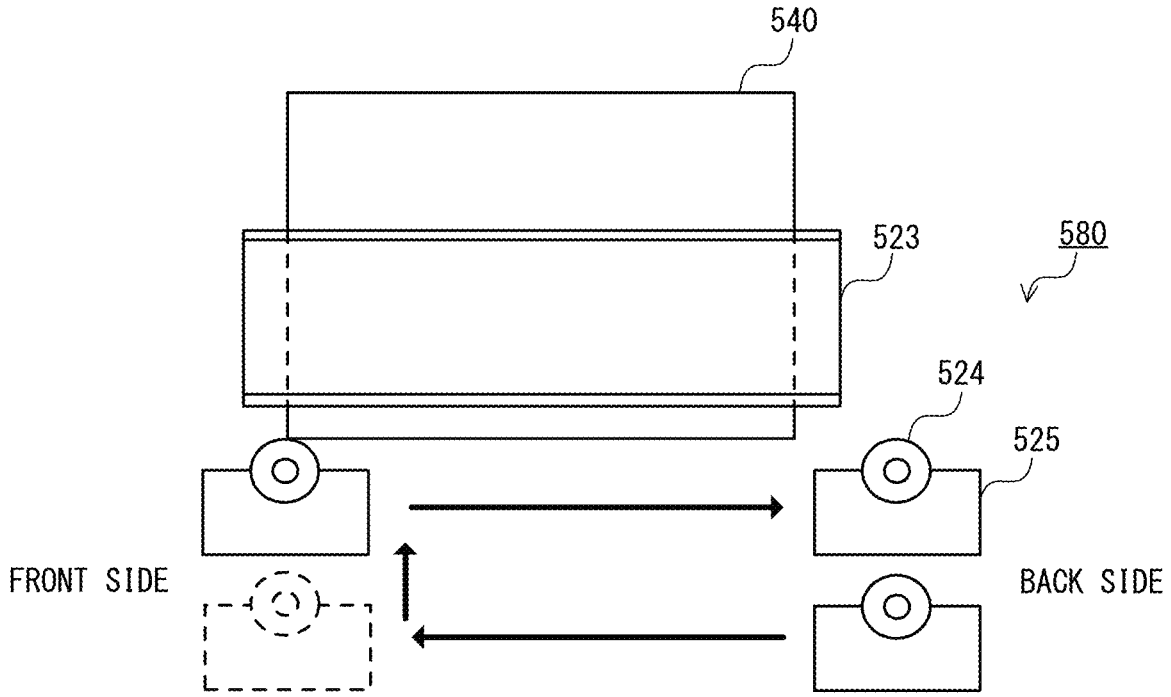
FIG. 10 is an explanatory view for illustrating an operation of the gluing unit.

FIG. 9 is an explanatory view for illustrating a configuration of the gluing unit 905. FIG. 10 is an explanatory view for illustrating an operation of the gluing unit 905. As described above, the gluing unit 905 includes the gluing gripper 523, the glue container 525, the glue application roller 524, and the glue application roller control motor 522. The gluing gripper 523 is configured to grip the sheet bundle 540. The glue container 525 is configured to store the glue. The glue application roller 524 is configured to apply the glue onto the sheet bundle. The glue container 525, the glue application roller 524, and the glue application roller control motor 522 form a glue application unit 580.

The glue application roller 524 is immersed into the glue in the glue container 525, and is held in a constantly rotating state by the glue application roller control motor 522. The sheet bundle 540 is gripped in an upright state with use of the gluing gripper 523. The glue application unit 580 is moved in parallel to the sheet bundle 540 in a longitudinal direction of the lower surface of the sheet bundle 540 being in the upright state.

The glue is applied through reciprocation of the glue application unit 580. As illustrated in FIG. 10, the glue application unit 580 starts moving from an initial position on a back side of the case binding apparatus 500 and stops at a predetermined position on a front side of the case binding apparatus 500. At this time, the glue is not applied onto the lower surface of the sheet bundle 540 with the glue application unit 580. The glue is applied onto the sheet bundle 540 while the glue application unit 580 is being moved from the front side to the back side of the case binding apparatus 500. The glue application unit 580 is stopped at the predetermined position and raised to a position at which the glue application roller 524 abuts against the lower surface of the sheet bundle 540. The glue application unit 580 is moved from the front side to the back side of the case binding apparatus 500 under the above-mentioned state to thereby apply the glue onto the lower surface of the sheet bundle 540 with use of the glue application roller 524.

Bonding Unit

FIG. 11A to FIG. 11E and FIG. 12A to FIG. 12C are explanatory views for illustrating the bonding unit 906.

Figure 11A:
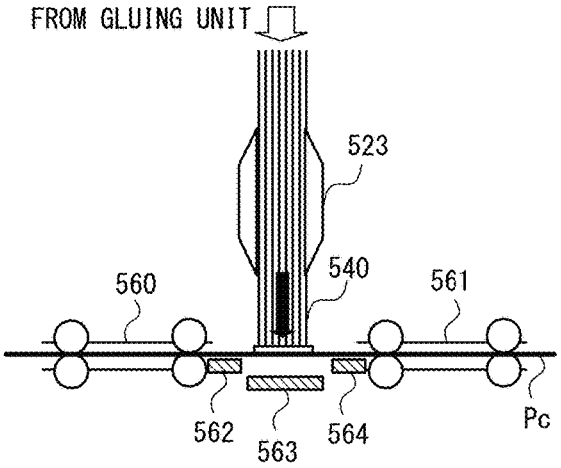
FIG. 11A to FIG. 11E are explanatory views for illustrating a bonding unit.

In FIG. 11A, a cross section of the bonding unit 906 is illustrated. The bonding unit 906 includes conveyance guides 560 and 561, a pressurizing member 563, and folding members 562 and 564. The conveyance guides 560 and 561 receive the cover sheet Pc supplied from the image forming apparatus 10 via the conveyance path 503 and stops the cover sheet Pc at a predetermined position. The pressurizing member 563 brings the cover sheet Pc into pressure contact with the glue-applied surface of the sheet bundle 540. The folding members 562 and 564 fold the cover sheet Pc so that the cover sheet Pc covers the sheet bundle 540.

Figure 11B:
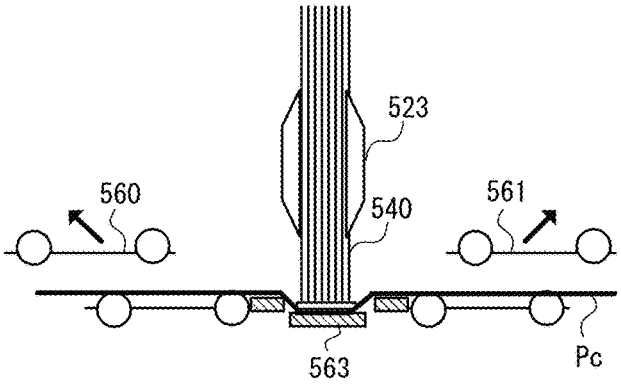

In FIG. 11A, after an operation of applying the glue onto the sheet bundle 540 with use of the gluing unit 905 is terminated, the gluing gripper 523 is lowered from the gluing unit 905 while still gripping the sheet bundle 540. The glue-applied surface of the sheet bundle 540 is bonded to the cover sheet Pc, which is prepared and held in the horizontal direction by the conveyance guides 560 and 561. In FIG. 11B, after the glue-applied surface of the sheet bundle 540 is bonded, the gluing gripper 523 is further lowered. In this manner, a bonding portion of the cover sheet Pc placed on the pressuring member 563 is brought into pressure contact with the glue-applied surface of the sheet bundle 540. Before the pressure contact with the glue-applied surface is achieved through the lowering of the sheet bundle 540, an upper part of the conveyance guide 560 and an upper part of the conveyance guide 561 are retreated upward. In this manner, interference of the upper part of the conveyance guide 560 and the upper part of the conveyance guide 561 with the sheet bundle 540 is prevented.

Figure 11C:
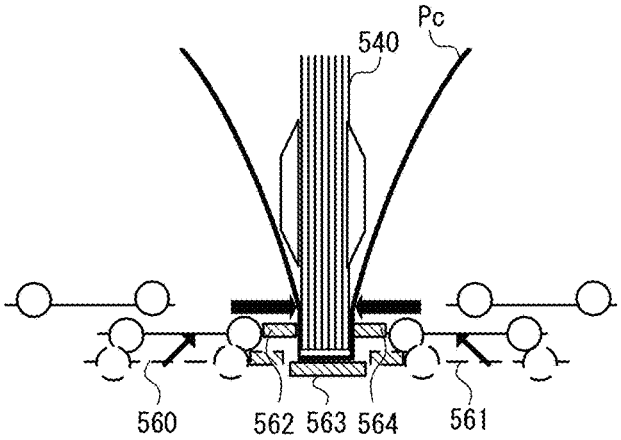

After the cover sheet Pc is bonded to the sheet bundle 540, the folding members 562 and 564, a lower part of the conveyance guide 560, and a lower part of the conveyance guide 561 are raised in an obliquely upward direction with respect to the pressurizing member 563 (FIG. 11C). Specifically, the folding members 562 and 564, the lower part of the conveyance guide 560, and the lower part of the conveyance guide 561 are moved from positions indicated by the broken lines to positions indicated by the solid lines in the directions indicated by the arrows of FIG. 11C. Through the rise of the folding members 562 and 564 in the obliquely upward directions, the cover sheet Pc is pushed upward so that side edges of the glue-applied surface are curved to cover the sheet bundle 540. The case binding processing is performed in the manner described above.

Figure 11D:
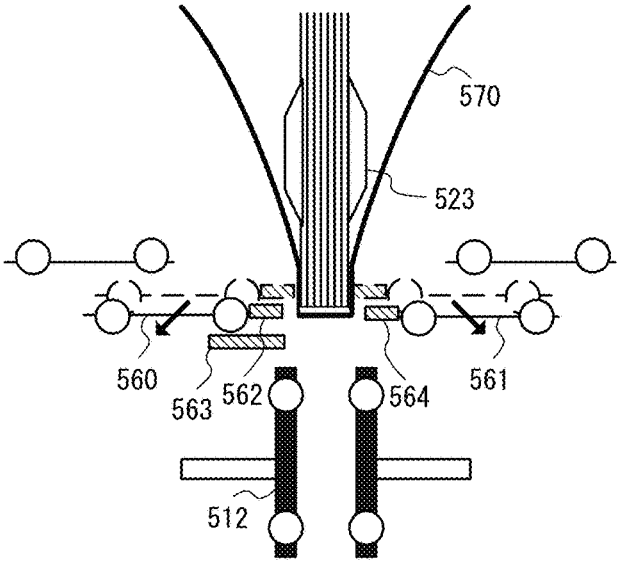
Figure 11E:
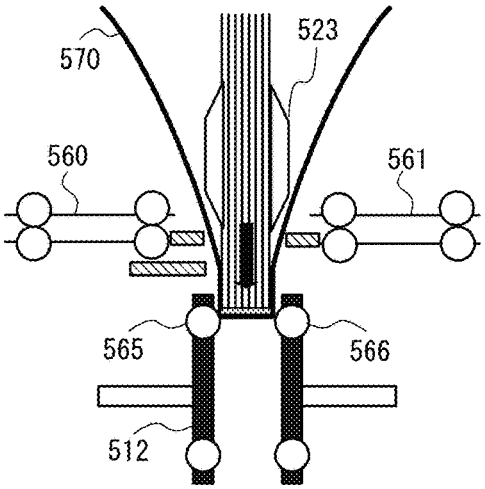

After the case binding processing for the cover sheet Pc is terminated, the folding members 562 and 564, the lower part of the conveyance guide 560, and the lower part of the conveyance guide 561 are retreated from the positions indicated by the broken lines to the positions indicated by the solid lines (FIG. 11D). At the same time, the pressurizing member 563 is moved in the horizontal direction. As a result of the horizontal movement of the pressurizing member 563, a space through which the book 570 formed by covering the sheet bundle 540 with the cover sheet Pc can be lowered is ensured. The book 570 is lowered by the gluing gripper 523 to such a position that a lower end of the book 570 abuts against trim-unit transfer rollers 565 and 566 of the trim gripper 512 (FIG. 11E).

Figure 12A:
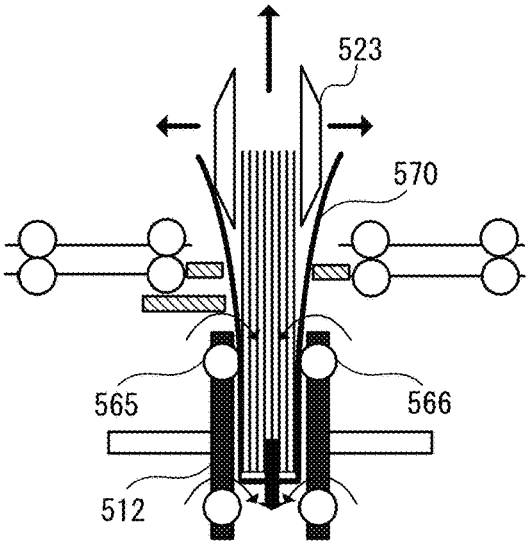
FIG. 12A, FIG. 12B, and FIG. 12C are explanatory views for illustrating the bonding unit.
Figure 12B:
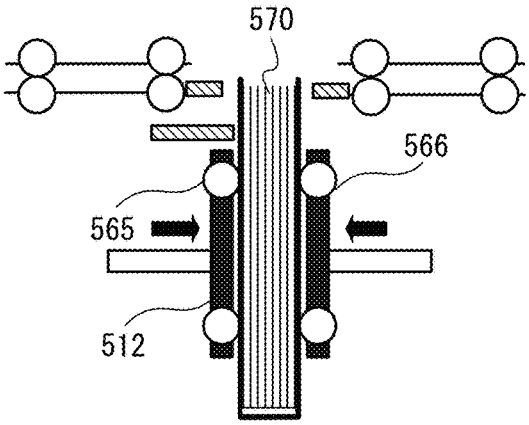
Figure 12C:
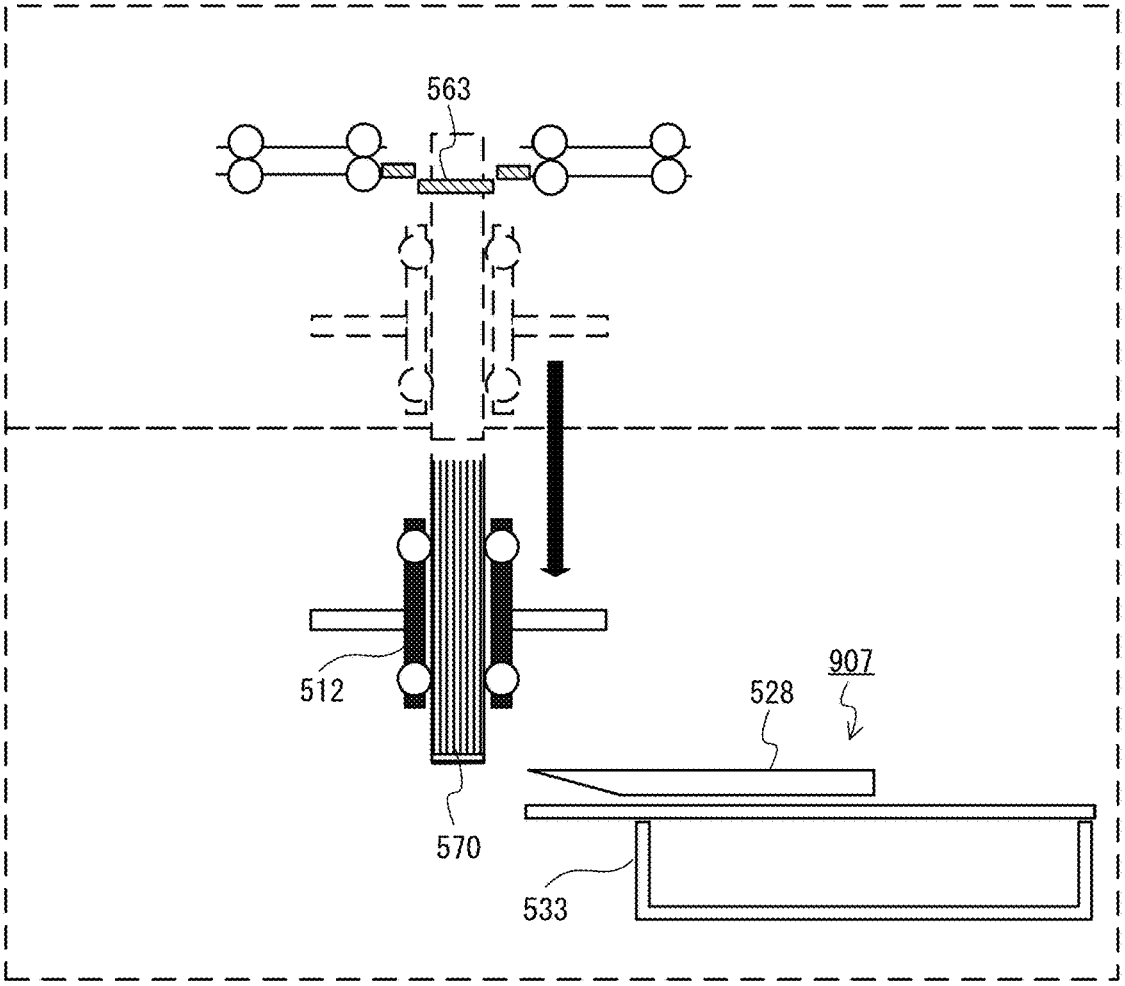

The gluing gripper 523, which has lowered the book 570, releases the gripping of the book 570 (FIG. 12A). At the same time, the book 570 is conveyed in a downward direction by the trim-unit transfer rollers 565 and 566. The book 570, which is conveyed in the downward direction, is stopped at a predetermined position (FIG. 12B). The trim gripper 512 grips the stopped book 570. The book 570 is lowered to a position of the cutting unit 907 by the trim gripper 512 (FIG. 12C). At this time, the pressurizing member 563, which has been moving in the horizontal direction, is returned to such a position as to be able to bring the bonding portion of the cover sheet Pc into pressure contact with the glue-applied surface.

Cutting Unit

FIG. 13A to FIG. 13D are explanatory views for illustrating the cutting unit 907. The cutting unit 907 includes the cutter 528 and cuts the ends of the book 570, which has been moved with use of the trim gripper 512. The trim gripper 512, the cutter 528, and the cutting-waste receiving box 533 perform cutting in conjunction with each other in the cutting unit 907.

A cutting operation for the book 570 is performed on three sides, specifically, a fore edge, a top edge, and a tail edge. The book 570 is moved from the bonding unit 906 with an end of the spine being positioned on a lower side. Hence, the book 570 is rotated at the time of cutting. After the trim gripper 512 is rotated by 90 degrees to change an orientation of the book 570 by 90 degrees as illustrated in FIG. 13A, the cutting unit 907 cuts the tail edge of the book 570. Next, after the trim gripper 512 is rotated by 90 degrees in the same direction, the cutting unit 907 cuts the fore edge of the book 570. Further, after the trim gripper 512 is rotated by 90 degrees, the cutting unit 907 cuts the top edge of the book 570. Through the process described above, the cutting of the ends other than the spine of the book 570 is terminated.

Figure 13B:
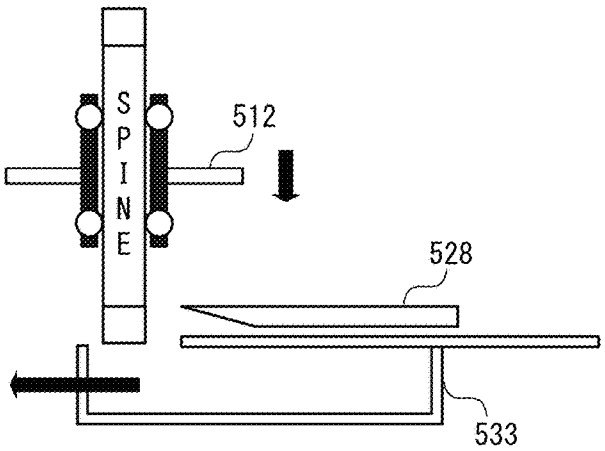
FIG. 13A to FIG. 13D are explanatory views for illustrating a cutting unit.
Figure 13A:
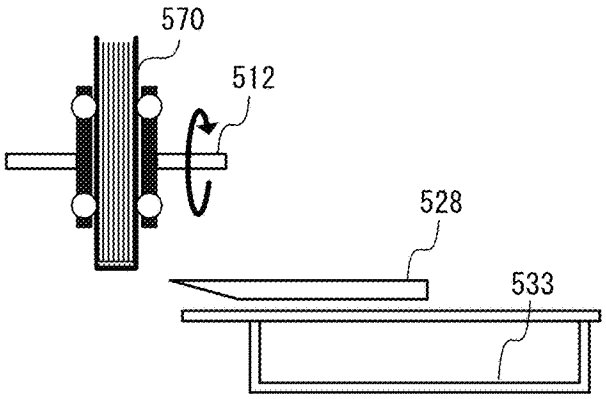
Figure 13C:
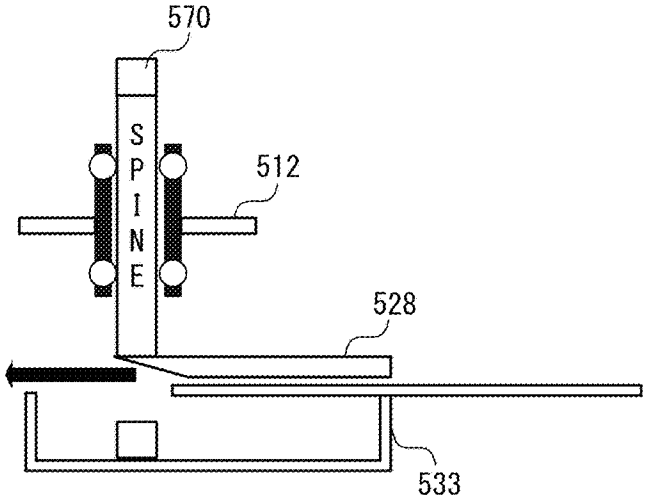
Figure 13D:
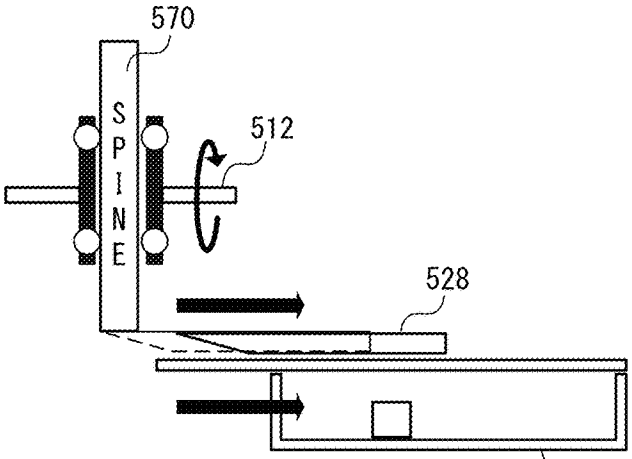

In the cutting operation, before cutting with the cutter 528, as illustrated in FIG. 13B, the cutting unit 907 moves the cutting-waste receiving box 533 to a position below the book 570, at which the cutting waste falls. After that, the cutting unit 907 causes the cutter 528 to project toward the book 570 so as to cut one side. As illustrated in FIG. 13C, the cutting waste is stored in the cutting waste receiving box 533 that is present below the book 570. After the cutting, as illustrated in FIG. 13D, the cutter 528 is driven in the opposite direction to be moved to a retreated position. The cutting-waste receiving box 533 is also moved to a retreated position.

Figure 14:
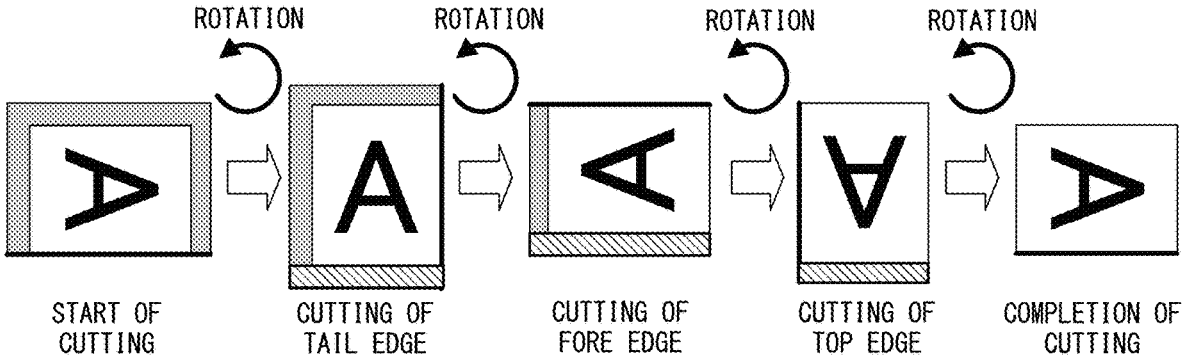
FIG. 14 is an explanatory view for illustrating a state of a book at the time of cutting.

FIG. 14 is an explanatory view for illustrating a state of the book 570 at the time of cutting. The book 570 after the cutting is conveyed to the book discharge unit 908 with the spine being oriented downward. Thus, after the completion of the cutting, the trim gripper 512 further rotates the book 570 by 90 degrees.

Figure 15:
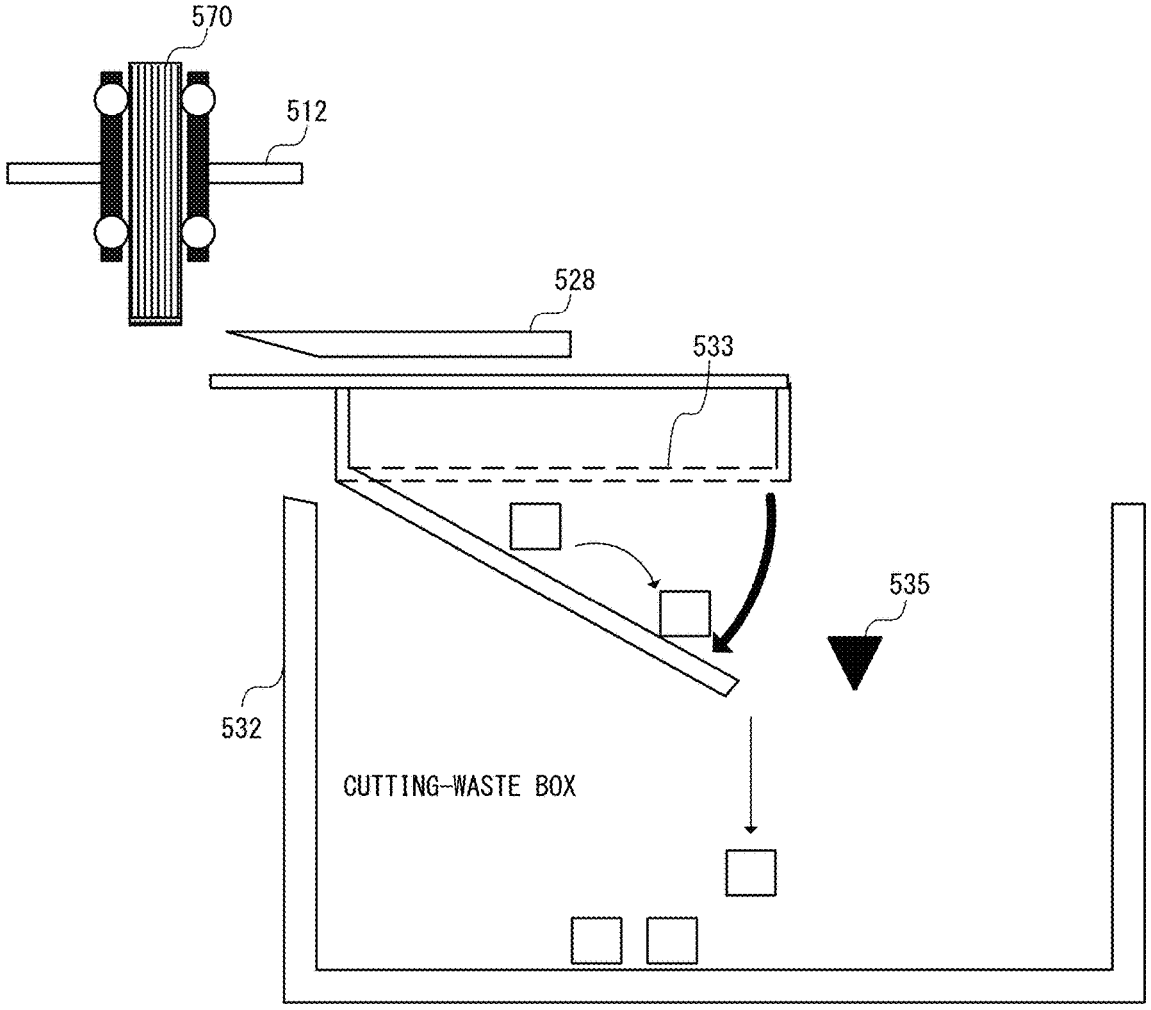
FIG. 15 is an explanatory view for illustrating an operation of discharging cutting waste.

The cutting-waste receiving box 533 is moved between the retreated position at which the cutting operation is not performed and a waste receiving position at which the cutting operation is performed. The retreated position of the cutting-waste receiving box 533 is located above the cutting-waste box 532. FIG. 15 is an explanatory view for illustrating an operation of discharging the cutting waste. As illustrated in FIG. 15, a bottom plate of the cutting-waste receiving box 533 has an openable configuration. When the cutting-waste receiving box 533 is moved to the retreated position, the bottom plate is opened to release the cutting waste inside the cutting-waste receiving box 533 to the cutting-waste box 532.

The cutting-waste box 532 includes a cutting-waste full load detection sensor 535. When the cutting-waste full load detection sensor 535 detects accumulation of a predetermined amount of the cutting waste in the cutting-waste box 532, it is determined that the cutting-waste box 532 is in a fully loaded state with the cutting waste. In the following description, the cutting-waste box 532 in the fully loaded state with the cutting waste is also described as full load of the cutting waste. At the time of the full load of the cutting waste, the image forming apparatus 10 interrupts the image formation operation and displays, on the operation display apparatus 600, a message to urge a user to remove the cutting waste. When the cutting-waste full load detection sensor 535 detects that the full load of the cutting waste is cleared, the image forming apparatus 10 restarts the image formation operation.

Book Discharge Unit

FIG. 16A to FIG. 16D are explanatory views for illustrating the book discharge unit 908.

Figure 16A:
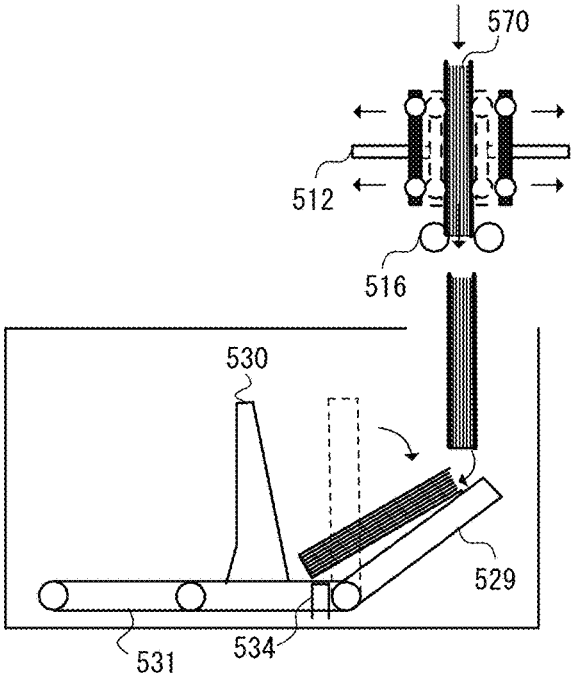
FIG. 16A to FIG. 16D are explanatory views for illustrating a book discharge unit.

FIG. 16A is an explanatory view for illustrating a configuration of the book discharge unit 908. The book discharge unit 908 includes a pair of book discharge unit inlet rollers 516 and a book stacking plate 529. The pair of book discharge unit inlet rollers 516 is configured to convey the book 570 gripped by the trim gripper 512. The book stacking plate 529 is configured to temporarily stack the conveyed book 570 thereon. The book discharge unit 908 further includes a book support plate 530, a stacking stabilizing plate 534, and a discharge and conveyance belt 531. The book support plate 530 and the stacking stabilizing plate 534 are configured to support the book 570 in a vertical direction. The discharge and conveyance belt 531 is configured to move the book support plate 530 in the horizontal direction.

The book 570 after the termination of the cutting processing is transferred by the trim gripper 512 to the pair of book discharge unit inlet rollers 516 provided immediately below the cutting unit 907. After the trim gripper 512 releases the support for the book 570 to transfer the book 570 to the pair of book discharge unit inlet rollers 516, the trim gripper 512 is moved to a predetermined position in the bonding unit 906. The pair of book discharge unit inlet rollers 516 conveys the book 570 to the book stacking plate 529. At this time, the book stacking plate 529 is inclined in the right direction. The book 570 is stacked onto the book stacking plate 529 through the pair of book discharge unit inlet rollers 516.

Figure 16B:
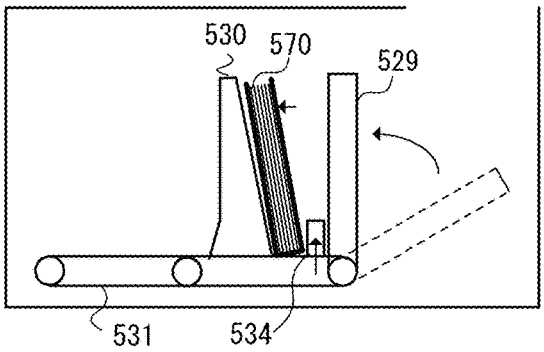
Figure 16C:
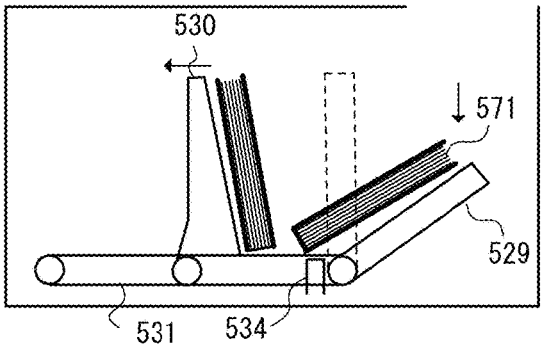
Figure 16D:
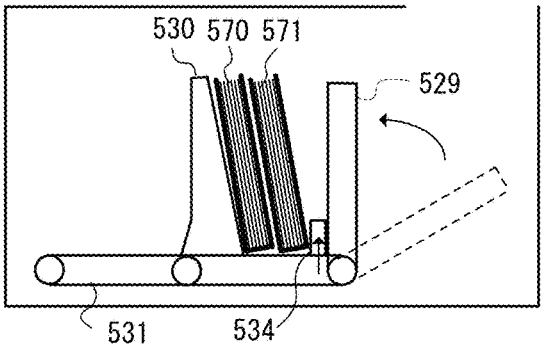

After the book 570 is stacked, the book stacking plate 529 stands upright to place the book 570 vertically. The book 570 is supported in an upright state between the book support plate 530 and the stacking stabilizing plate 534 (FIG. 16B). After that, the book support plate 530 is moved by the discharge and conveyance belt 531 to ensure a discharge space for a subsequent book 571 when the book 571 is conveyed (FIG. 16C). The book stacking plate 529 is operated again as illustrated in FIG. 16A and FIG. 16B to store the subsequent book 571 in the upright state adjacent to the book 570 (FIG. 16D).

Determination of Transfer Order of Sheet

Figure 17:
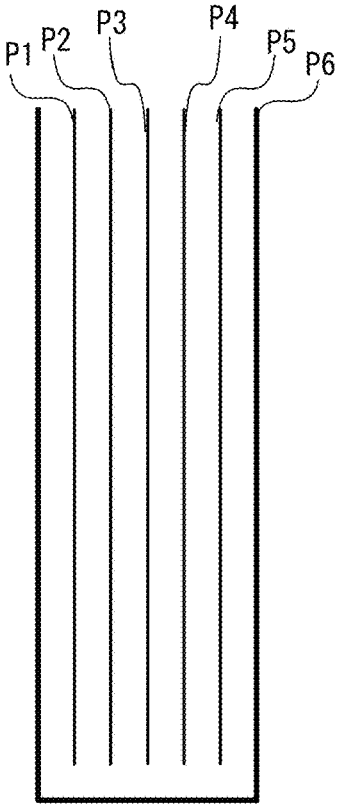
FIG. 17 is a schematic view of the book.

FIG. 17 is a schematic view of the book formed by the case binding apparatus 500. The book includes five inner sheets P1 to P5 and one cover sheet P6. In this embodiment, as described above, the inner sheets and the cover sheet are transferred in the stated order from the image forming apparatus 10 to the case binding apparatus 500. Thus, in a case of the five inner sheets P1 to P5 and the one cover sheet P6, the sheets are transferred in the order of P1, P2, P3, P4, P5, and P6 from the image forming apparatus 10 to the case binding apparatus 500. The CPU 801 of the image forming apparatus 10 can determine the order (transfer order) of each of the sheets in the sheet bundle, which are to be transferred from the image forming apparatus 10 to the case binding apparatus 500, based on the number of inner sheets.

Determination of Execution of Image Formation Processing

Figure 18:
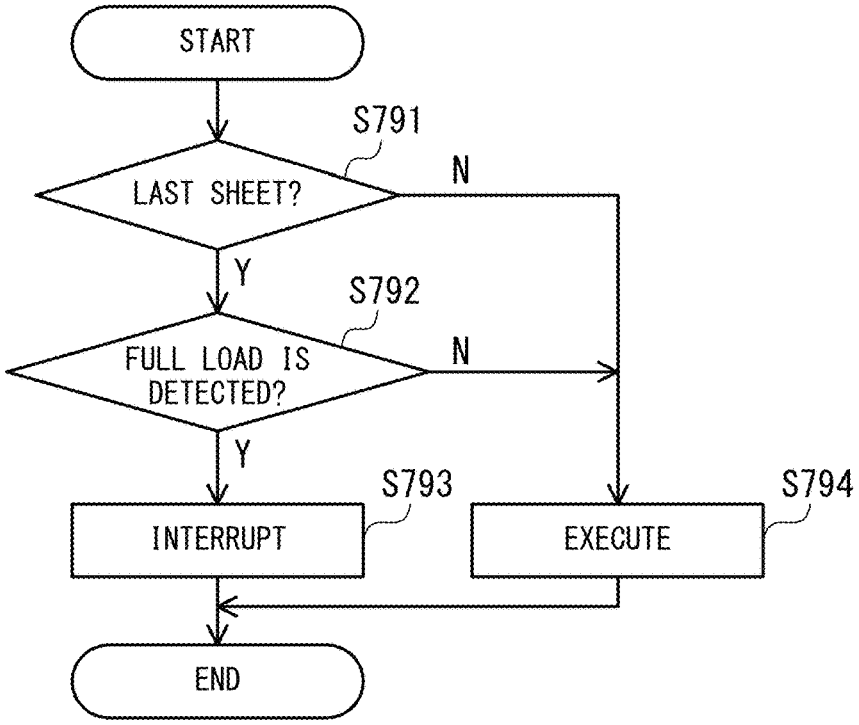
FIG. 18 is a flowchart for illustrating processing of determining whether to allow execution of image formation processing.

The image forming apparatus 10 determines whether to allow execution of the image formation processing in accordance with a result of detection by the cutting-waste full load detection sensor 535 and the transfer order of the sheet from the image forming apparatus 10 to the case binding apparatus 500. FIG. 18 is a flowchart for illustrating processing of determining whether to allow execution of the image formation processing. The processing is performed at the start of the image formation for each of the sheets.

As described above with reference to FIG. 17, the CPU 801 of the image forming apparatus 10 determines the transfer order of the sheet in the sheet bundle before the image formation on the sheet (Step S791). In this step, the CPU 801 determines whether or not the sheet is the last sheet to be transferred in the sheet bundle, specifically, the sheet is a cover sheet. When the sheet is not the last sheet to be transferred (Step S791: N), the CPU 801 determines that the sheet is an inner sheet. In this case, the CPU 801 determines that the image formation processing can be executed by the image forming apparatus 10 for the sheet (Step S794).

When the sheet is the last sheet to be transferred (Step S791: Y), the CPU 801 determines whether or not the cutting-waste full load detection sensor 535 is in a cutting-waste full load detecting state (Step S792). The CPU 801 acquires a result of detection by the cutting-waste full load detection sensor 535 from the case binding apparatus 500 to perform the determination. When the cutting-waste full load detection sensor 535 is not in the cutting-waste full load detecting state (Step S792: N), the CPU 801 determines that the image formation processing can be executed by the image forming apparatus 10 for the sheet (Step S794). When the cutting-waste full load detection sensor 535 is in the cutting-waste full load detecting state (Step S792: Y), the CPU 801 determines the interruption of the image formation processing performed by the image forming apparatus 10 for the sheet (Step S793). Specifically, before the image formation is performed for the last sheet to be transferred, the CPU 801 determines, with the cutting-waste full load detection sensor 535, whether or not the cutting-waste box 532 is fully loaded with the cutting waste. When the sheet is not the last sheet to be transferred, the CPU 801 does not determine whether or not the cutting-waste box 532 is fully loaded with the cutting waste. The CPU 801 interrupts the image formation processing when the fully loaded state of the cutting-waste box 532 is detected.

Figure 19:
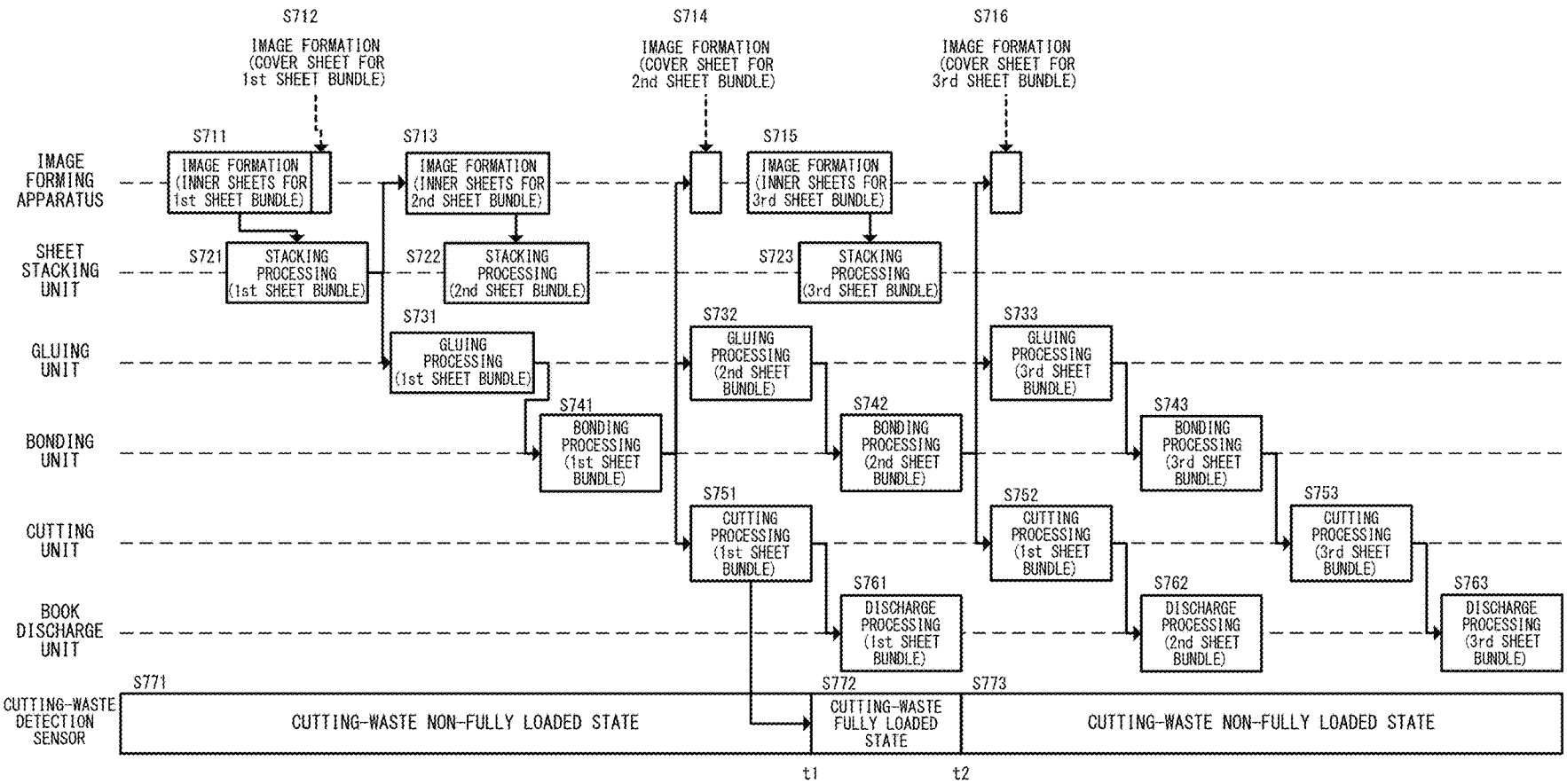
FIG. 19 is a processing flowchart during a bookbinding job.

FIG. 19 is a processing flowchart during a bookbinding job. FIG. 19 is the processing flowchart for illustrating a flow of processing performed by the image forming apparatus 10 and a flow of processing performed by the case binding apparatus 500 in a case in which three sheet bundles are subjected to case binding to form three books.

The image forming apparatus 10 first performs the image formation for the inner sheets forming a first sheet bundle (Step S711) and then performs the image formation for a cover sheet for the first sheet bundle (Step S712). The sheet stacking unit 904 of the case binding apparatus 500 performs the stacking processing for the first sheet bundle (Step S721). Then, after the termination of the stacking processing for the first sheet bundle, the gluing unit 905 performs the gluing processing for the first sheet bundle (Step S731). After that, the bonding unit 906 performs the bonding processing for the first sheet bundle (Step S741). The cutting unit 907 performs the cutting processing for the first sheet bundle (Step S751). The book discharge unit 908 performs the discharge processing for a first book formed of the first sheet bundle (Step S761).

In parallel to the gluing processing performed by the gluing unit 905 for the first sheet bundle (Step S731), the image forming apparatus 10 performs the image formation for inner sheets of a second sheet bundle (Step S713). The sheet stacking unit 904 performs the stacking processing for the second sheet bundle (Step S722). In parallel to the cutting processing performed by the cutting unit 907 for the first sheet bundle (Step S751), the image forming apparatus 10 performs the image formation for a cover sheet for the second sheet bundle (Step S714). The gluing unit 905 performs the gluing processing for the second sheet bundle (Step S732). After that, the bonding unit 906 performs the bonding processing for the second sheet bundle (Step S742). The cutting unit 907 performs the cutting processing for the second sheet bundle (Step S752). The book discharge unit 908 performs the discharge processing for a second book formed of the second sheet bundle (Step S762).

After the termination of the image formation for the cover sheet for the second sheet bundle, the image forming apparatus 10 performs the image formation for inner sheets of a third sheet bundle (Step S715). The sheet stacking unit 904 performs the stacking processing for the third sheet bundle (Step S723). In parallel to the cutting processing performed by the cutting unit 907 for the second sheet bundle (Step S752), the image forming apparatus 10 performs the image formation for a cover sheet for the third sheet bundle (Step S716). The gluing unit 905 performs the gluing processing for the third sheet bundle (Step S733). After that, the bonding unit 906 performs the bonding processing for the third sheet bundle (Step S743). The cutting unit 907 performs the cutting processing for the third sheet bundle (Step S753). The book discharge unit 908 performs the discharge processing for a third book formed of the third sheet bundle (Step S763).

Processing of determining whether to allow execution of the image formation processing for each of the sheets in a total of three sheet bundles is described with reference to FIG. 18 and FIG. 19. In FIG. 19, the cutting-waste full load detection sensor 535 is brought into a state of detecting the full load of the cutting waste at a time (t1) after the cutting processing (Step S751) for the first sheet bundle (Step S772). At a time (t2) immediately after the time t1, the waste is thrown away by a user to clear the fully loaded state (Step S773).

In the processing in Step S711 of FIG. 19, the CPU 801 determines the transfer order of the sheet to be transferred from the image forming apparatus 10 to the case binding apparatus 500 (Step S791). The inner sheets are transferred from the image forming apparatus 10 to the case binding apparatus 500, but do not include the last sheet to be transferred (Step S791: N). Thus, the CPU 801 does not determine whether or not to interrupt the execution of the image formation processing based on the cutting-waste full load detecting state, and determine to execute the image forming processing (Step S794).

Meanwhile, in the processing in Step S712 of FIG. 19, the cover sheet is transferred from the image forming apparatus 10 to the case binding apparatus 500. However, the cover sheet is the last sheet to be transferred (Step S791: Y). Thus, the CPU 801 determines whether or not the cutting-waste full load detection sensor 535 is in the cutting-waste full load detecting state (Step S792). At this time, as illustrated in Step S771 of FIG. 19, the cutting-waste full load detection sensor 535 is not in the cutting-waste full load detecting state (Step S792: N). Thus, the CPU 801 determines the execution of the image formation processing (Step S794).

In the processing in Step S713 and Step S714, the CPU 801 performs the same determinations as those performed for the first sheet bundle even for inner sheets of the second sheet bundle and a sheet serving as a cover sheet of the second sheet bundle.

Next, at the timing t1 during the image formation processing for inner sheets of the third sheet bundle in Step S715 of FIG. 19, the cutting-waste full load detecting state is detected by the cutting-waste full load detection sensor 535. On this occasion, the inner sheets are transferred from the image forming apparatus 10 to the case binding apparatus 500. However, the inner sheets do not include the last sheet to be transferred (Step S791: N). Thus, the CPU 801 continues the image formation processing without interrupting the image formation processing based on the cutting-waste full load detecting state (Step S794).

When the interruption of the image formation processing is determined based only on the result of detection by the cutting-waste full load detection sensor 535 regardless of the transfer order of the sheet in the sheet bundle, the image formation processing is interrupted when the cutting-waste box 532 becomes fully loaded during the image formation for the inner sheets. For example, when the cutting-waste box 532 becomes fully loaded (t1) during the image formation for the inner sheets of the third sheet bundle (Step S715), the image formation processing is interrupted during the image formation for the inner sheets of the third sheet bundle. Even when a user immediately removes the cutting waste to clear the fully loaded state detected by the cutting-waste full load detection sensor 535 (t2), unnecessary downtime is generated due to interruption processing, which has already been started.

Meanwhile, in this embodiment, the transfer order of the sheet in the sheet bundle is determined. For the sheets other than the last sheet to be transferred, the interruption of the image formation processing is not determined based on the cutting-waste full load detecting state. Thus, when a user immediately removes the cutting waste at the time of full load of the cutting waste to clear the fully loaded state with the cutting waste, the interruption processing for the image formation is not started yet. Thus, the print job can be continued without interrupting the image formation processing. As a result, the generation of unnecessary downtime can be prevented.

As described above, in a case in which the sheet for which the image formation is to be performed is the inner sheet, the image forming apparatus 10 continues the image formation processing even when the cutting-waste full load detection sensor 535 detects the fully loaded state of the cutting-waste box 532. After that, when the cutting-waste full load detection sensor 535 does not detect the fully loaded state of the cutting-waste box 532 before the start of the image formation for the cover sheet, the image formation apparatus 10 continues the image formation for the cover sheet. The cutting-waste full load detection sensor 535 still detects the fully loaded state of the cutting-waste box 532, the image formation apparatus 10 interrupts the image formation for the cover sheet. Moreover, the cutting waste collected in the cutting-waste box 532 in the bookbinding operation, during which the case binding apparatus 500 does not perform the cutting, is removable by a user.

As described above, the image forming apparatus 10 of this embodiment determines whether to allow execution of the image formation processing for all the sheets for which the image formation based on the full load state of the cutting waste and the transfer order of the sheet in the sheet bundle, for which the image formation is to be performed. The image forming apparatus 10 interrupts the image formation processing when the cutting-waste box is fully loaded at the time of image formation for the sheet having a predetermined transfer order. Thus, in a case in which a user immediately performs processing for dealing with the fully loaded state so as to clear the fully loaded state when the cutting-waste box is fully loaded, the image formation processing is not unnecessarily interrupted. As a result, the print job is continued to prevent the generation of downtime. The image forming apparatus 10 and the case binding apparatus 500 have been described as different apparatus independent of each other. However, the image forming apparatus 10 and the case binding apparatus 500 may be formed integrally with each other. Further, the configuration in which the cutting unit 907 is included in the case binding apparatus 500 has been described above. However, the cutting unit may be provided outside the case binding apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-118525, filed Jun. 22, 2018 which is hereby incorporated by reference herein in its entirety.

What is claimed is:

1. An image forming apparatus, comprising:

an image forming unit configured to form an image on a sheet;

a bookbinding unit configured to perform bookbinding of a sheet bundle including a plurality of sheets;

a cutting unit configured to cut a predetermined side of the sheet bundle formed by the bookbinding in the bookbinding unit;

a waste box configured to collect cutting waste produced by the cutting;

a detector configured to detect a fully loaded state of the waste box, which corresponds to collection of a predetermined amount of the cutting waste in the waste box; and a controller configured to:

control, when an order of the sheet in the sheet bundle, on which the image is to be formed, is smaller than a predetermined order, the image forming unit to not perform interruption of image formation processing which is due to detection of the fully loaded state of the waste box detected by the detector, and;

control, when the order of the sheet is the predetermined order, the image forming unit to interrupt the image formation processing in accordance with the fully loaded state of the waste box, which is detected by the detector.

2. The image forming apparatus according to claim 1, wherein, when the sheet in the sheet bundle, on which the image is to be formed, is other than a last sheet, the controller controls the image forming unit to not perform interruption of the image formation processing which is due to detection of the fully loaded state of the waste box detected by the detector.

3. The image forming apparatus according to claim 1, wherein, the controller controls the image forming unit to interrupt the image formation processing in accordance with the fully loaded state of the waste box, which is detected by the detector, when the order of the sheet in the sheet bundle is the predetermined order and continues the image formation processing performed by the image forming unit when the fully loaded state of the waste box is not detected by the detector.

4. The image forming apparatus according to claim 1, wherein the image forming unit forms an image on a sheet serving as a cover sheet after forming an image on a sheet serving as an inner sheet in the sheet bundle, and wherein, when the sheet on which the image is to be formed is the inner sheet, the controller controls the image forming unit to continue the image formation processing even after the fully loaded state of the waste box is detected by the detector and, wherein, when the sheet on which the image is to be formed is the cover sheet, the controller controls the image forming unit to continue the image formation for the cover sheet in a case in which the fully loaded state of the waste box, which has been detected by the detector, is cleared before start of the image formation for the cover sheet and controls the image forming unit to interrupt the image formation for the cover sheet in a case in which the fully loaded state of the waste box is not cleared before start of the image formation for the cover sheet.

5. The image forming apparatus according to claim 4, wherein the bookbinding unit covers the sheet bundle with the cover sheet to perform the bookbinding.

6. The image forming apparatus according to claim 1, wherein, while the bookbinding unit is executing a bookbinding operation during which the cutting unit does not perform cutting, the cutting waste collected in the waste box is removable by a user.

7. The image forming apparatus according to claim 1, wherein the cutting unit includes a waste receiving box, which is provided at a position at which the cutting waste produced by the cutting falls, and is configured to release the cutting waste to the waste box after a cutting operation performed by the cutting unit is terminated.

8. The image forming apparatus according to claim 7, wherein the bookbinding unit includes:

a gluing unit configured to apply glue to a predetermined side of the sheet bundle; and a bonding unit configured to bond a cover sheet onto the sheet bundle having the glue-applied predetermined side, wherein the cutting unit cuts three sides of the sheet bundle onto which the cover sheet is bonded, other than the glue-applied side of the sheet bundle, and wherein, after the cutting operation for the three sides by the cutting unit is terminated, the waste receiving box releases the cutting waste into the waste box.

9. An image forming apparatus to be connected to a cutting apparatus, the cutting apparatus including:

a cutting unit configured to cut a predetermined side of a sheet bundle formed by bookbinding;

a waste box configured to collect cutting waste produced by the cutting; and a detector configured to detect a fully loaded state of the waste box, which corresponds to collection of a predetermined amount of the cutting waste in the waste box, the image forming apparatus comprising:

an image forming unit configured to form an image on a sheet; and a controller configured to:

control, when an order of the sheet in the sheet bundle, on which the image is to be formed, is smaller than a predetermined order, the image forming unit to not perform interruption of image formation processing which is due to detection of the fully loaded state of the waste box detected by the detector; and control, when the order of the sheet is the predetermined order, the image forming unit to interrupt the image formation processing in accordance with the fully loaded state of the waste box, which is detected by the detector.

* * * * *